US009120612B2

(12) United States Patent
Fath et al.

(10) Patent No.: US 9,120,612 B2
(45) Date of Patent: Sep. 1, 2015

(54) FOLDED DISPENSING UNIT AND BLANK

(71) Applicant: Altria Client Services Inc., Richmond, VA (US)

(72) Inventors: Scott A. Fath, Richmond, VA (US); Carl Miller, Richmond, VA (US)

(73) Assignee: ALTRIA CLIENT SERVICES INC., Richmond, VA (US)

( * ) Notice: Subject to any disclaimer, the term of this patent is extended or adjusted under 35 U.S.C. 154(b) by 101 days.

(21) Appl. No.: 13/900,975

(22) Filed: May 23, 2013

(65) Prior Publication Data

US 2013/0313311 A1 Nov. 28, 2013

Related U.S. Application Data

(60) Provisional application No. 61/651,331, filed on May 24, 2012.

(51) Int. Cl.

| | |
|---|---|
| ***B65D 5/72*** | (2006.01) |
| ***B65D 83/04*** | (2006.01) |
| ***B65D 5/54*** | (2006.01) |
| ***A47F 1/08*** | (2006.01) |
| ***B65D 5/02*** | (2006.01) |
| ***B65D 83/02*** | (2006.01) |

(52) U.S. Cl.

CPC ..... *B65D 83/0481* (2013.01); *A47F 1/08* (2013.01); *B65D 5/0281* (2013.01); *B65D 5/541* (2013.01); *B65D 5/542* (2013.01); *B65D 5/725* (2013.01); *B65D 83/02* (2013.01); *B65D 2583/005* (2013.01)

(58) Field of Classification Search

CPC ..... B65D 5/725; B65D 5/541; B65D 5/542; B65D 5/0281; B65D 83/0481; B65D 83/02; B65D 2583/005; A47F 1/08

USPC ..... 229/122.1, 240–242; 221/155, 187, 221/194, 197, 281–283, 286, 287, 302, 305, 221/309

See application file for complete search history.

(56) References Cited

U.S. PATENT DOCUMENTS

| | | | | | |
|---|---|---|---|---|---|
| 1,694,897 | A | * | 12/1928 | Chaffin | 221/198 |
| 1,753,957 | A | * | 4/1930 | Chaffin | 221/311 |
| 1,898,056 | A | * | 2/1933 | Johnson | 229/122.1 |
| 3,228,582 | A | * | 1/1966 | Osberg | 229/238 |
| 3,708,108 | A | * | 1/1973 | Rosenburg, Jr. | 229/225 |
| 3,934,791 | A | * | 1/1976 | Dick et al. | 229/132 |
| 4,726,471 | A | * | 2/1988 | Whately et al. | 206/554 |
| 5,390,821 | A | | 2/1995 | Market | |
| 5,597,114 | A | * | 1/1997 | Kramedjian et al. | 229/122.1 |
| 5,788,117 | A | | 8/1998 | Zimmanck | |

(Continued)

OTHER PUBLICATIONS

International Search Report and Written Opinion of the International Searching Authority issued Sep. 27, 2013 by the ISA/US in International Application No. PCT/US13/00138.

(Continued)

*Primary Examiner* — Gary Elkins

(74) *Attorney, Agent, or Firm* — Buchanan, Ingersoll & Rooney PC

(57) ABSTRACT

A folded dispensing unit and a blank therefore, wherein the blank is adapted to be glued and shipped in a folded condition and erected and further folded at a point of sale, and a method of erecting the glued and folded blank. The dispensing unit includes an interior slot adapted to receive a carton including a plurality of individual products to be dispensed.

11 Claims, 9 Drawing Sheets

(56) References Cited

U.S. PATENT DOCUMENTS

| | | | | |
|---|---|---|---|---|
| 6,357,652 | B1 | 3/2002 | Evans et al. | |
| 2005/0263577 | A1 | 12/2005 | Walsh et al. | |
| 2007/0295790 | A1 | 12/2007 | Zammit et al. | |
| 2009/0152136 | A1* | 6/2009 | White et al. | 206/223 |
| 2012/0223090 | A1* | 9/2012 | Thomas et al. | 221/1 |

OTHER PUBLICATIONS

International Preliminary Report on Patentability mailed May 21, 2015 for PCT/US2013/000138.

* cited by examiner

FOLDED DISPENSING UNIT AND BLANK

TECHNICAL FIELD

It would be desirable to provide a novel dispensing unit for consumer goods and in particular, for smokeless tobacco products, which are packaged in tubular containers and disposed within a rectangular carton.

The present disclosure relates to a folded dispensing unit adapted to be glued and shipped in a folded state and erected at a point of sale into a dispenser which can receive a carton containing a plurality of individual tubular containers of smokeless tobacco products.

SUMMARY

Disclosed herein is a dispensing unit, i.e., dispenser adapted to receive a carton, particularly suited for tubular packages of articles, such as smokeless tobacco products, or any other types of consumer goods.

According to one embodiment, a dispensing unit comprises a dispenser having an interior receiving slot; and a carton configured to contain a plurality of tubular containers which is removably disposed within the interior receiving slot of the dispenser; wherein said dispenser includes a dispensing opening aligned with an opening in said carton, the opening in the carton being adapted to dispense one of said plurality of tubular containers therethrough. The dispensing unit may further comprise a sleeve disposed around an exterior of the dispenser.

A further embodiment provides a blank for a dispenser comprising a first rectangular panel having at least one tab and defining a dispensing opening; a second rectangular panel hingedly connected to said first rectangular panel; a third rectangular panel hingedly connected to said second rectangular panel along a fold line, said fold line including at least one slit for receiving the at least one tab; a fourth rectangular panel hingedly connected to said third rectangular panel and having a first tuck flap; a fifth rectangular panel hingedly connected to said fourth rectangular panel; a sixth rectangular panel hingedly connected to said fifth rectangular panel and having a second tuck flap; and a glue flap.

According to another embodiment, a method of folding a blank for a dispenser is provided, wherein the blank comprises a first rectangular panel having at least one tab hingedly connected thereto along at least a first fold line and defining a dispensing opening; a second rectangular panel hingedly connected to said first rectangular panel along a third fold line; a third rectangular panel hingedly connected to said second rectangular panel along a fourth fold line, said fold line including at least one slit; a fourth rectangular panel hingedly connected to said third rectangular panel along a fifth fold line and having a first tuck flap; a fifth rectangular panel hingedly connected to said fourth rectangular panel along an eighth fold line; a sixth rectangular panel hingedly connected to said fifth rectangular panel along a ninth fold line and having a second tuck flap; and a glue flap hingedly connected to said sixth rectangular panel along a twelfth fold line, said method comprising pre-breaking the third, fifth, ninth and twelfth fold lines; folding the blank 180 degrees about the eighth fold line; gluing the glue flap to an inner surface of the third rectangular panel adjacent to the fourth fold line; pre-breaking the fourth fold line; gluing the fifth rectangular panel to an inner surface of the first rectangular panel such that the ninth fold line is spaced from the third fold line by a predetermined distance; wherein the glue flap has a predetermined width, the predetermined width of the glue flap being substantially equal to the predetermined distance; pre-breaking the at least one first fold line; and folding the first rectangular panel such that the at least one tab is inserted into the at least one slit and thereby forming an interior slot within the dispenser.

BRIEF DESCRIPTION OF THE DRAWING FIGURES

DETAILED DESCRIPTION

Figure 1:
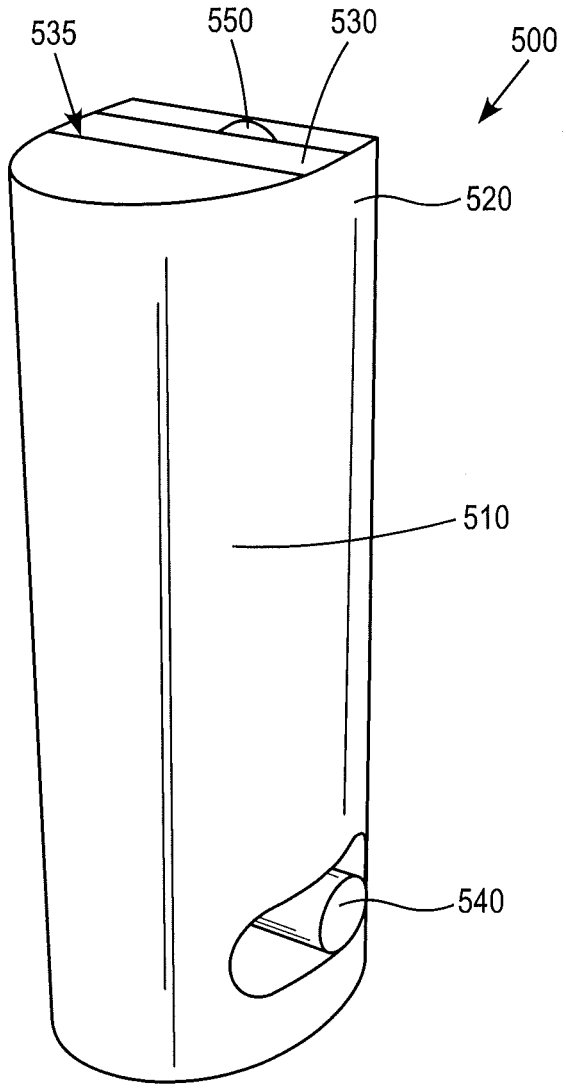
FIG. 1 shows a perspective view of a dispensing unit in an erected state, with a container shown in a slightly withdrawn condition.
Figure 2:
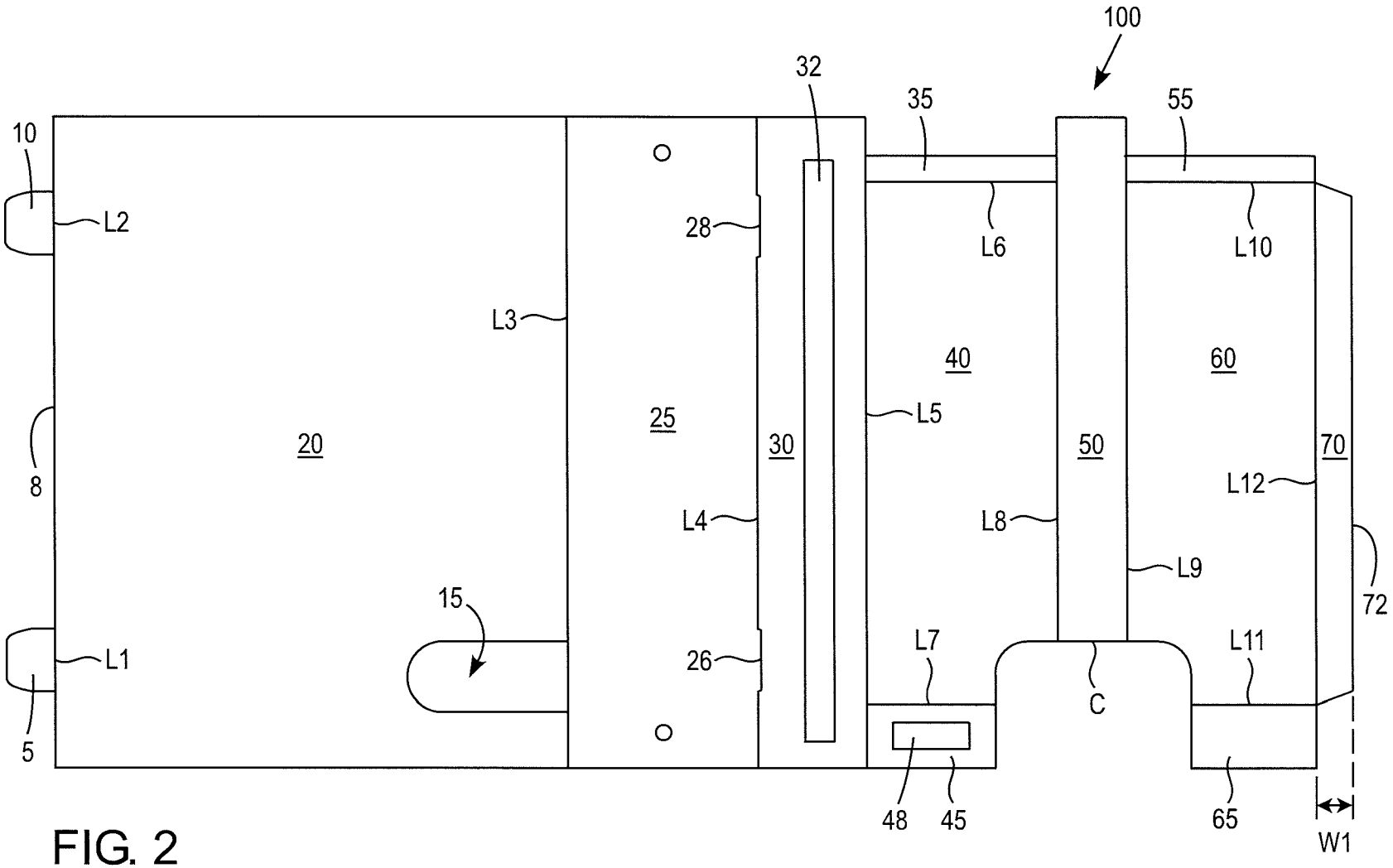
FIG. 2 is a planar view of a dispenser blank for a dispenser in an unfolded state.

Referring to FIG. 1, dispensing unit 500 comprises a dispenser 510, a sleeve 520 extending around dispenser 510, and a carton 530 removably inserted within a carton slot 535 formed between two walls within an interior of the dispenser 510. Carton 530 preferably contains a plurality of tubular containers 540 to be dispensed one at a time, as described in further detail below. The tubular container may contain a plurality of individual piece goods, and is particularly well suited for smokeless tobacco products, or any other type of consumer goods. The dispensing unit 500 can be attached to existing fixtures with magnets 550, as shown, double-sided adhesive tape, or similar attachment means A dispenser blank 100 for the dispenser 510 is described herein. As shown in FIG. 2, the blank 100 comprises a first rectangular panel 20, a second rectangular panel 25, a third rectangular panel 30, a fourth rectangular panel 40, a fifth rectangular panel 50, a sixth rectangular panel 60, and a glue flap 70. The first rectangular panel 20 has first and second tabs 5, 10 and a dispensing opening 15. The tabs 5, 10 are connected to the first panel 20 along first and second fold lines L1, L2, respectively. The second rectangular panel 25 is hingedly connected to the first rectangular panel 20 along a third fold line L3. The third rectangular panel 30 is hingedly connected to the second rectangular panel 25 along a fourth fold line L4, which further includes slits 26, 28 for receiving the first and second tabs 5, 10. The third rectangular panel 30 further includes an adhesive strip 32, such as a pressure sensitive tape, covered with a releasable paper. The fourth rectangular panel 40 and the sixth rectangular panel 60 include tuck flaps 45, 65, respectively, connected by fold lines L7, L11. The tuck flaps 45, 65 are folded one upon the other when the dispenser 510 is erected to form the bottom of the carton receiving slot 535. Tuck flap 45 includes a glue strip 48 covered with a releasable paper to maintain the folded and tucked configuration, as described below, and provide a double reinforced bottom surface. As illustrated, the tuck flaps 45, 65, fourth rectangular panel 40, fifth rectangular panel 50 and sixth rectangular panel 60 form a cut-away area "C" having rounded corners. The fourth rectangular panel 40 and the sixth rectangular panel 60 also include guide panels 35, 55, respectively, connected by fold lines L6, L10. During erection of the dispenser 510, guide panels 35, 55 are folded away from each other so as to provide a broader, convergent opening at the top of the carton receiving slot 535. Such an arrangement facilitates insertion of a carton 530 into the interior opening of the carton slot 535.

Figure 3:
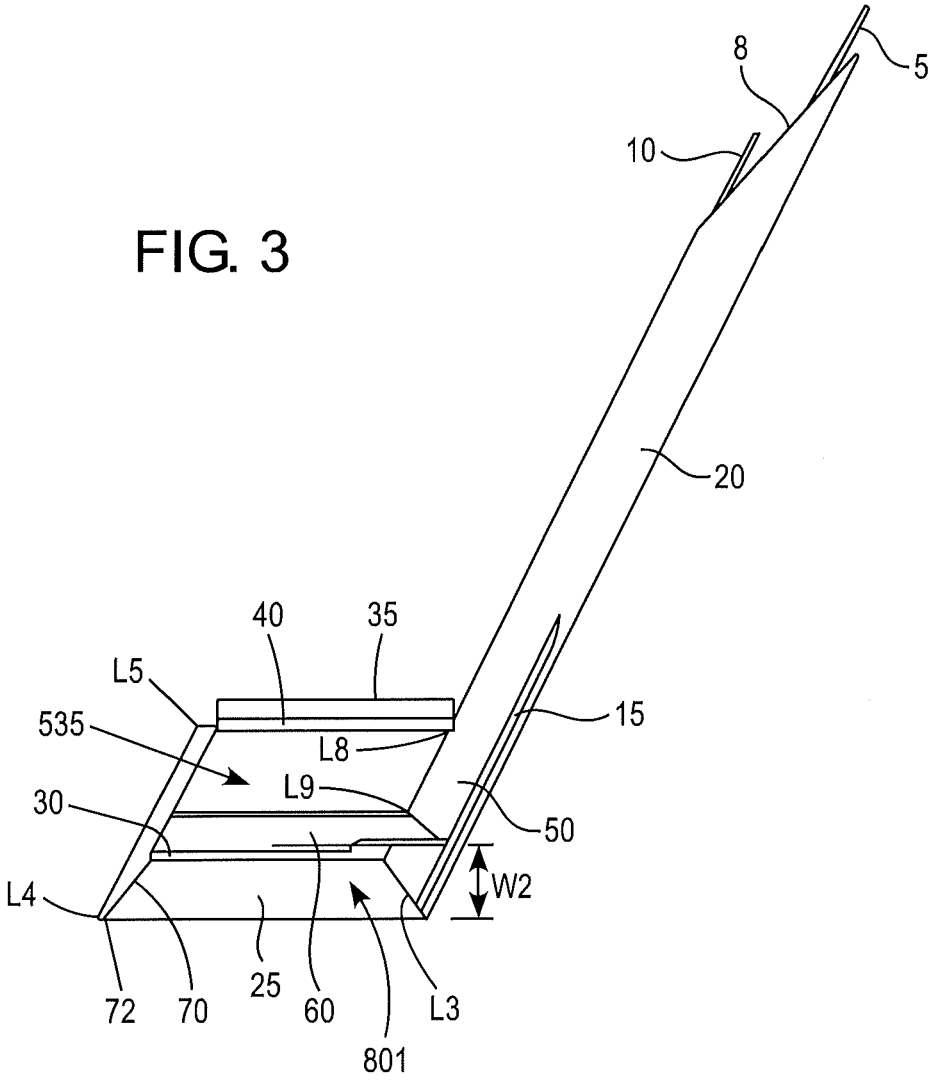
FIG. 3 shows a perspective view of the dispenser blank of FIG. 2 in a glued and folded state.

The dispenser blank 100 is preferably folded and glued so as to provide an erectable dispenser blank structure in a folded condition which can be erected and folded to form the dispenser 510. Hence, the dispenser blank is configured to be readily glued and folded into a collapsed state to facilitate shipping to the sales force, and the collapsed unit is readily erected and further folded in the field. More particularly, with reference also to FIG. 3, glue flap 70 is adapted to be glued to an inner or inside surface of the third rectangular panel ("interior side panel") 30 and fifth rectangular panel 50 is adapted to be glued to an inner or inside surface of the first rectangular panel 20. The glue flap 70 is glued such that the long edge 72 of glue flap 70 is adjacent to an inner surface of fold line L4, and preferably positioned with clearance for the slits 26 and 28. Fold lines L3, L5, L9, and L12 are preferably pre-broken by folding 180°, fold line L8 is then folded 180° and the inner surface of glue flap 70 is then glued to the inner surface of third panel 30. Fifth panel 50 is glued such that the fold line L9 is spaced from an inner surface of fold line L3 by a predetermined distance W2 preferably essentially equal to a width W1 of glue flap 70. Fold line L4 is preferably pre-broken by folding 180° and the outer surface of fifth panel 50 is glued to the inner surface of first panel 20 to form a glued and folded blank structure. Hence, as shown in FIG. 3, a carton receiving slot 535 is defined. Preferably, the dispenser blank 100 as thus folded and glued is laid flat for shipping and then erected and further folded in the field.

The glued and folded blank 100 is erected to the state shown in FIG. 3 to form a carton receiving slot 535 between the fourth and sixth panels 40, 60 and between the third and fifth panels 30, 50. The carton receiving slot 535 is spaced from an inner surface of second panel 25 by a distance W2. In effect, the carton receiving slot 535 and the adjacent space 801 become first and second rectangular structures upon erection of the dispenser 510. The fold lines L1, L2 for tabs 5, 10 are preferably pre-broken, and first rectangular panel 20 is folded so as to align longitudinal edge 8 of first panel 20 with fold line L4 and tabs 5, 10 can be inserted into respective slits 26, 28 so as to form the semi-elliptical, cross-sectional shape of the dispenser 510, akin to that of a mailbox. Prior to inserting the tabs 5, 10 into the slits 26, 28, the releasable paper is preferably removed from glue strip 32 so that glue strip 32 adheres to an inner surface of first panel 20 and maintains connection of the panel 20 with the panel 30 and the semi-elliptical shape.

Thereafter, or prior to folding and gluing first rectangular panel 20, fold lines L7, L11 are pre-broken. The releasable paper is removed from glue strip 48 prior to folding tuck flap 45 inward and tuck flap 65 is then folded inward over tuck flap 45 and adhered thereto. The overlapping tuck flaps 45, 65 thus provide a double wall thickness and additional strength and support in forming the bottom of the carton slot 535 when the dispenser 510 is erected and vertically oriented to dispense containers from the carton through the dispenser opening 15. As illustrated, the erected dispenser 510 has a planar rear wall to facilitate attachment to a store fixture and the dispensing opening 15 is provided on a side of the rounded or semi-elliptical front wall formed by bending the first panel 20. The connection of the tuck flaps 45, 65 also reinforces the rectangular structures 535, 801.

Figure 4:
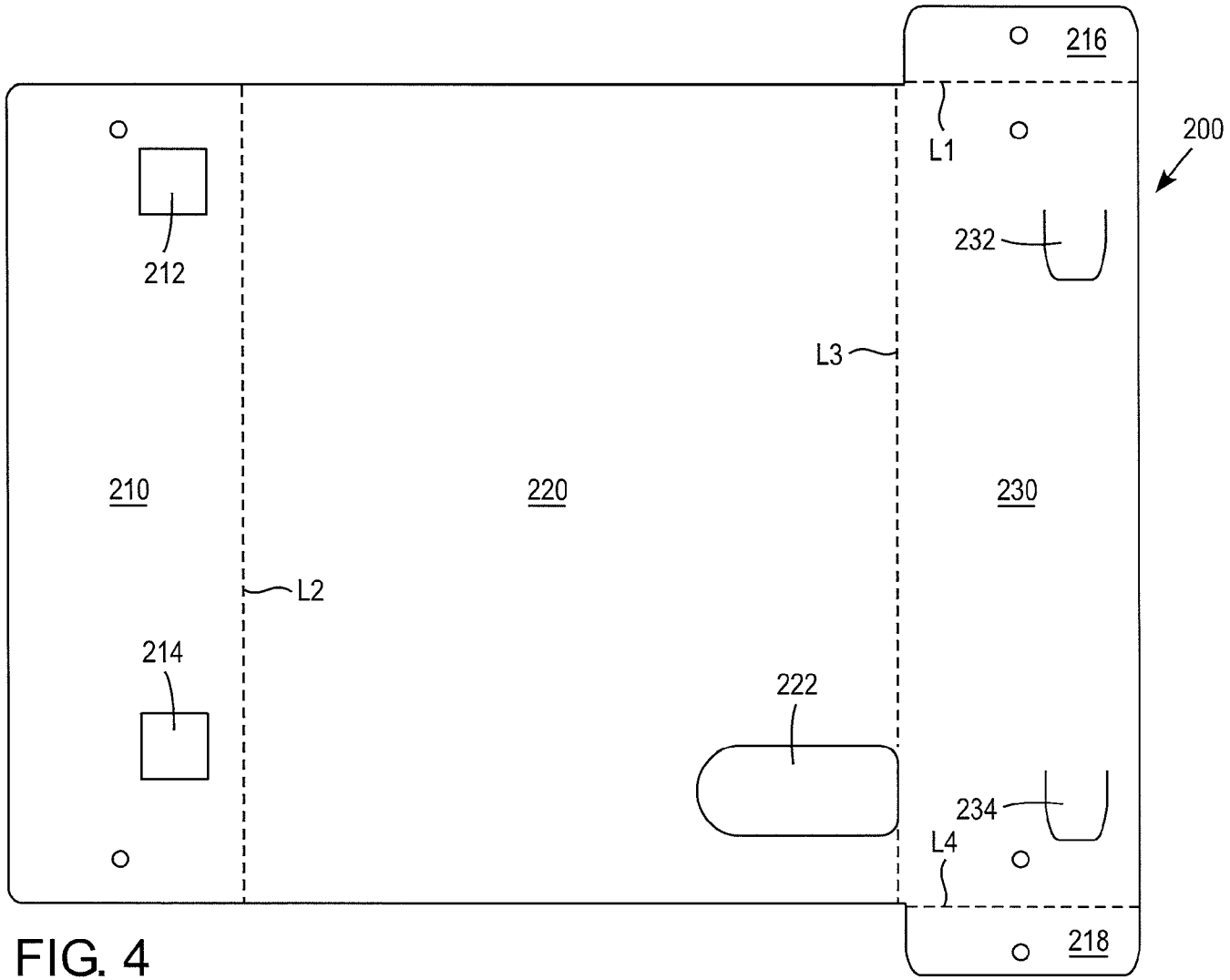
FIG. 4 shows a planar view of a sleeve blank in an unfolded state.

The dispenser blank 100 for the dispenser 510 preferably includes printed indicia, graphical ornamentation or the like, preferably at or along the outer surface of the panel 20. In order to protect the same, while also providing additional structural support to the dispenser 510, a transparent sleeve 520 is preferably disposed around dispenser 510. The sleeve 520 is erected from a sleeve blank 200 which is preferably made from PET, or a similar transparent material, so as not to obscure the printed indicia on the dispenser 510. With reference to FIG. 4, the sleeve blank 200 comprises a first end panel 210, a center panel 220, and a second end panel 230. First end panel 210 includes openings 212, 214 and second end panel 230 includes locking tabs 232, 234 to be inserted into openings 212, 214. Second end panel 230 further includes end flaps 216, 218 hingedly connected thereto along fold lines L1 and L4. The center panel 220 includes a cut-out 222 corresponding in size to dispensing opening 15 in dispenser blank 100. In order to place the sleeve blank 200 around the dispenser 510, fold lines L1-L4 are pre-broken by folding about 180°. The first end panel 210 is aligned with second rectangular panel ("back panel") 25 of the dispenser blank 100. The second rectangular panel 25 forms the planar rear or backside of the dispenser 510 when it is vertically oriented to dispense containers through the dispenser opening 15. While maintaining first end panel 210 in place, the sleeve blank 200 is wrapped around the dispenser 510 such that the cut-out 222 is aligned with the dispensing opening 15, and the locking tabs 232, 234 are then inserted into openings 212, 214, respectively, so as to secure the sleeve blank 200 in its position about the dispenser 510 and thereby form sleeve 520. The end flaps 216, 218 are then folded 180° to wrap around the end edges of second panel 25 and rest against an interior surface of second panel 25. The sleeve 520 is thus prevented from sliding longitudinally relative to the dispenser 510.

As shown in FIG. 1, the dispensing unit 500 further comprises a carton 530 removably inserted within a carton slot 535 formed between two walls within an interior of the dispenser 510. Carton 530 preferably contains a plurality of tubular containers 540, i.e., tubes, which are individually dispensed through the dispensing opening 15 of the dispenser 510. In a preferred embodiment, the carton 530 contains ten tubular containers arranged side-by-side such that when carton 530 is disposed vertically within the dispenser 510, as shown in FIG. 1, the next adjacent tubular container is gravity fed to the dispensing opening 15 as each tubular container is dispensed. The tubular containers may contain a plurality of individual pieces or products, such as smokeless tobacco products, or any other type of consumer goods. The container may also have forms other than tubular.

Figure 5:
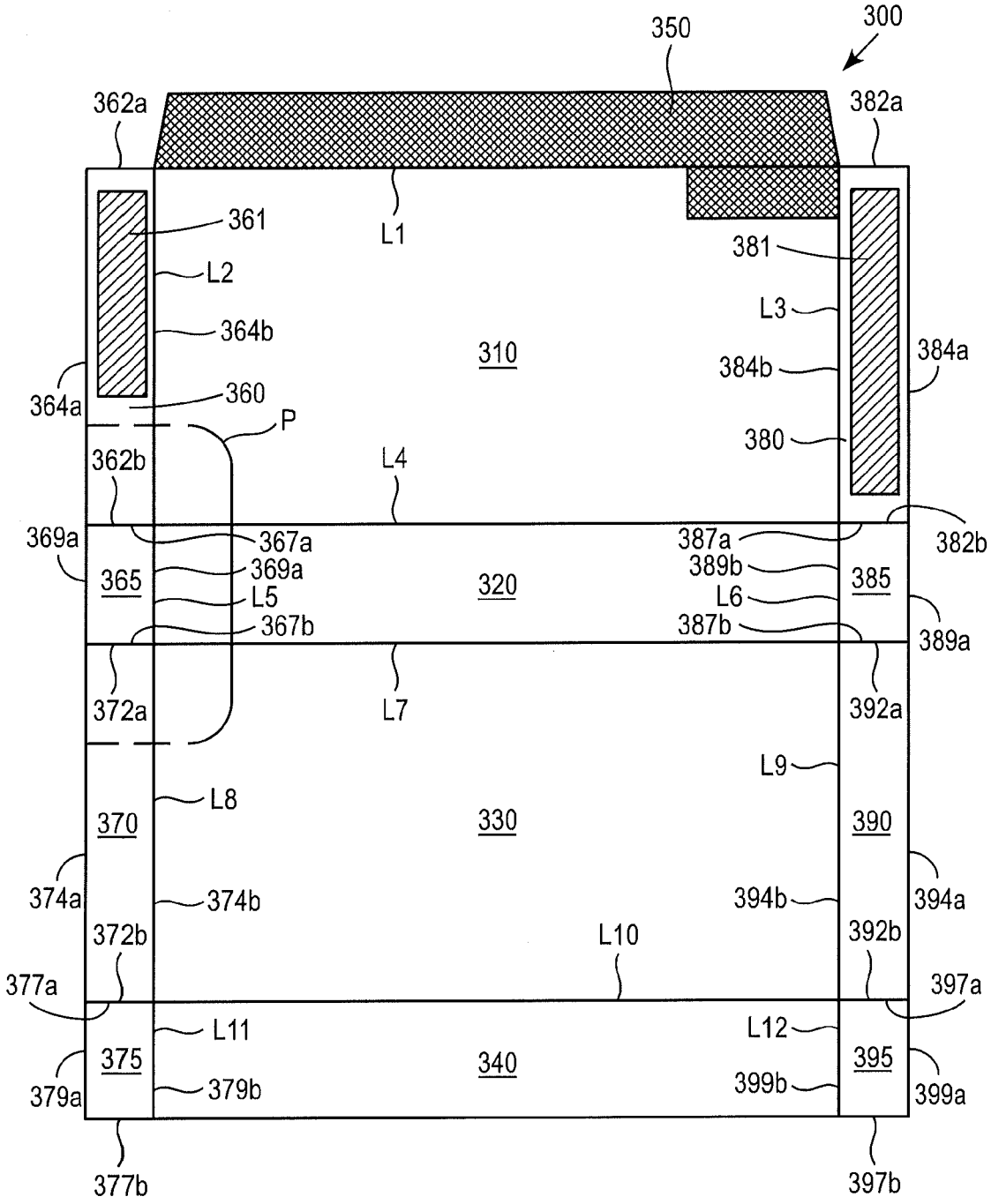
FIG. 5 shows a planar view of a carton blank in an unfolded state.

As shown in FIG. 5, a carton blank 300 comprises a first (side) rectangular panel 310, a second (front) rectangular panel 320, a third (side) rectangular panel 330, and a fourth (rear) rectangular panel 340. The carton blank 300 further comprises a glue flap 350, a first bottom panel 360, a second bottom panel 365, a third bottom panel 370, and a fourth bottom panel 375. The glue flap 350 is hingedly connected to the first rectangular panel 310 along a first fold line L1. The first bottom panel 360 has first and second short ends 362*a*, 362*b* and first and second long ends 364*a*, 364*b*, the second long end 364*b* of the first bottom panel 360 being hingedly connected to the first rectangular panel 310 along a second fold line L2. The first long end 364*a*, the first short end 362*a*, and the second short end 362*b* of the first bottom panel 360 are free ends. The first bottom panel 360 also includes an adhesive strip 361, such as a pressure sensitive tape, covered with a releasable paper. The second bottom panel 365 has first and second short ends 367*a*, 367*b* and first and second long ends 369*a*, 369*b*, the second long end 369*b* of the second bottom panel 365 being hingedly connected to the second rectangular panel 320 along a fifth fold line L5. The first long end 369*a*, the first short end 367*a*, and the second short end 367*b* of the second bottom panel 365 are free ends. The third bottom panel 370 has first and second short ends 372*a*, 372*b* and first and second long ends 374*a*, 374*b*, the second long end 374*b* of the third bottom panel 370 being hingedly connected to the third rectangular panel 330 along an eighth fold line L8. The first long end 374*a*, the first short end 372*a*, and the second short end 372*b* of the third bottom panel 370 are free ends. The fourth bottom panel 375 has first and second short ends 377*a*, 377*b* and first and second long ends 379*a*, 379*b*, the second long end 379*b* of the fourth bottom panel 375 being hingedly connected to the fourth rectangular panel 340 along an eleventh fold line L11. The first long end 379*a*, the first short end 377*a*, and the second short end 377*b* of the fourth bottom panel 375 are free ends.

As shown in FIG. 5, the carton blank 300 further comprises a first top panel 380, a second top panel 385, a third top panel 390, and a fourth top panel 395 similar in construction to the above-described bottom panels. The first top panel 380 has first and second short ends 382*a*, 382*b* and first and second long ends 384*a*, 384*b*, the second long end 384*b* of the first top panel 380 being hingedly connected to the first rectangular panel 310 along a third fold line L3. The first long end 384*a*, the first short end 382*a*, and the second short end 382*b* of the first top panel 380 are free ends. The first top panel 380 further includes an adhesive strip 381, such as a pressure sensitive tape, covered with a releasable paper. The second top panel 385 has first and second short ends 387*a*, 387*b* and first and second long ends 389*a*, 389*b*, the second long end 389*b* of the second top panel 385 being hingedly connected to the second rectangular panel 320 along a sixth fold line L6. The first long end 389*a*, the first short end 387*a*, and the second short end 387*b* of the second top panel 385 are free ends. The third top panel 390 has first and second short ends 392*a*, 392*b* and first and second long ends 394*a*, 394*b*, the second long end 394*b* of the third top panel 390 being hingedly connected to the third rectangular panel 330 along a ninth fold line L9. The first long end 394*a*, the first short end 392*a*, and the second short end 392*b* of the third top panel 390 are free ends. The fourth top panel 395 has first and second short ends 397*a*, 397*b* and first and second long ends 399*a*, 399*b*, the second long end 399*b* of the fourth top panel 395 being hingedly connected to the fourth rectangular panel 340 along a twelfth fold line L12. The first long end 399*a*, the first short end 397*a*, and the second short end 397*b* of the fourth top panel 395 are free ends.

Figure 6:
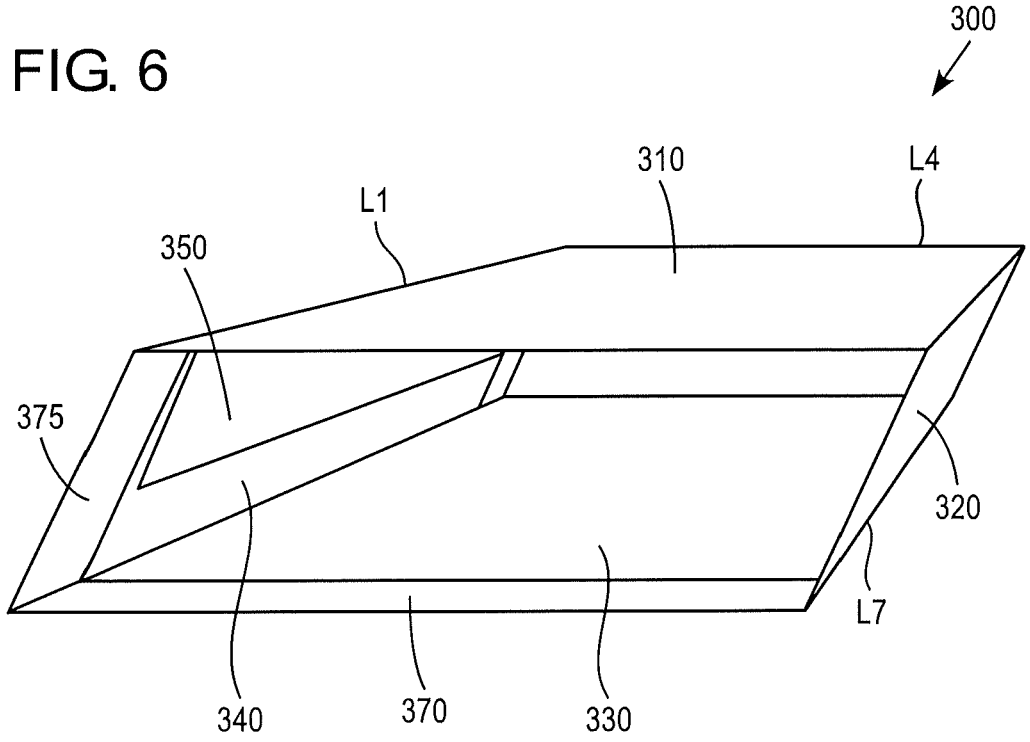
FIG. 6 shows a perspective view of the carton blank of FIG. 5 in a glued and folded state.
Figure 7A:
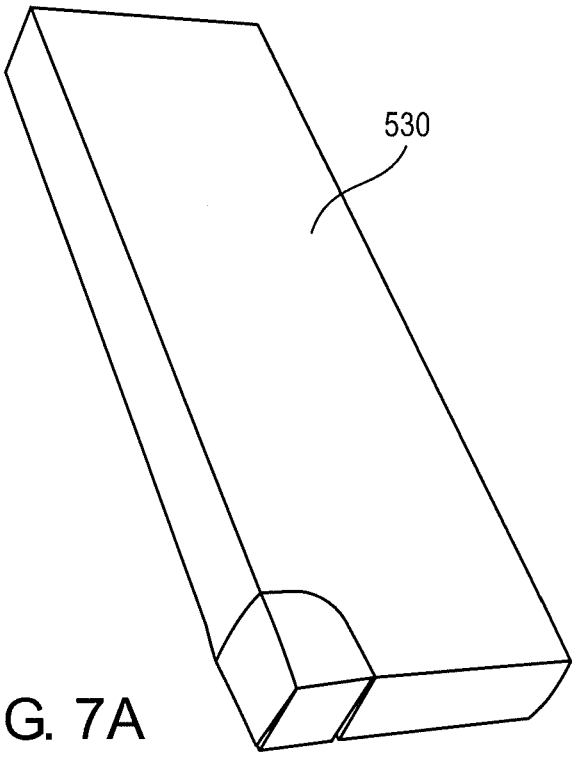
FIGS. 7A and 7B show a perspective view of the carton in an erected and sealed state, and in an erected and open state, respectively.

Referring to FIG. 6, the carton blank 300 is folded by pre-breaking fold lines L1 and L7 and then folding the blank 180° along fold line L4. The glue flap 350 is then glued to an inside surface of fourth rectangular panel 340. The bottom end of the carton blank 300 is closed by folding second bottom panel 365 and fourth bottom panel 375 inward, folding first bottom panel 360 inward so as to overlie the second and fourth bottom panels, and then folding the third bottom panel 370 inward such that an inner surface of third bottom panel 370 is adhered to the pressure sensitive tape 361 disposed on first bottom panel 360. The top end of the carton blank 300 is closed by folding second top panel 385 and fourth top panel 395 inward, folding first top panel 380 inward so as to overlie the second and fourth top panels, and then folding the third top panel 390 inward such that an inner surface of third top panel 390 is adhered to the pressure sensitive tape 381 disposed on first top panel 360. The carton 530 is thus sealed with the individual products disposed inside, as shown in FIG. 7A.

Figure 7B:
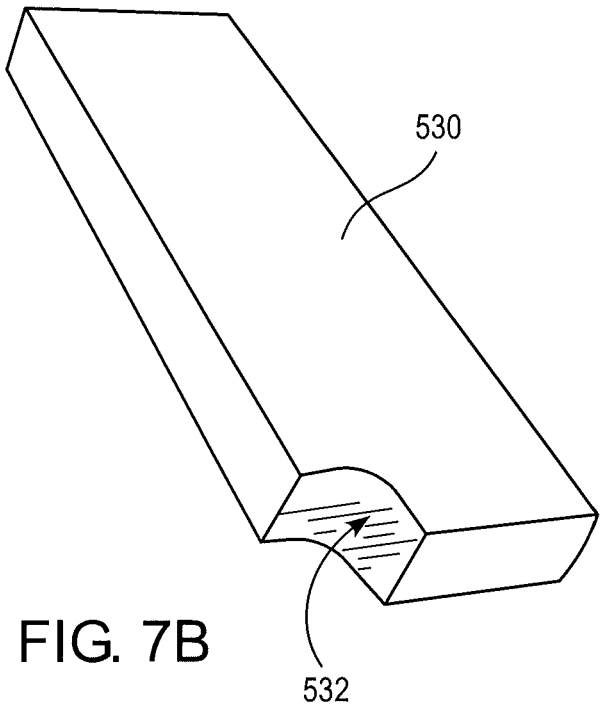

In order to dispense the products within carton 530, the carton 530 must be adapted for a dispensing or product removal opening 532, as shown in FIG. 7B. The opening 532 is formed by removing portions of the carton blank 300 defined along the perforated and/or cut line "P" extending across first bottom panel 360, first rectangular panel 310, second rectangular panel 320, third rectangular panel 330, and third bottom panel 370. The dispensing opening preferably allows the removal of product from the carton, one at a time. The size and configuration of the opening 532 formed in the carton 530 coincides with the cut-away area "C" defined by the tuck flaps 45, 65, fourth rectangular panel 40, fifth rectangular panel 50 and sixth rectangular panel 60 of the dispenser blank 100. That is, when the dispenser blank 100 is folded to form the carton slot 535, the cut-away area "C" defines an opening corresponding to the product removal opening 532 in the carton 530.

The dispenser 510 and sleeve 520 are reusable components. The carton 530 on the other hand is disposable after the product contained therein has been depleted. Thus, the merchant can continuously replace the cartons 530 within the same dispenser 510 as the product is used, or product to be dispensed can be simply changed merely by replacing a carton of a first product with a carton of a second product.

Figure 8:
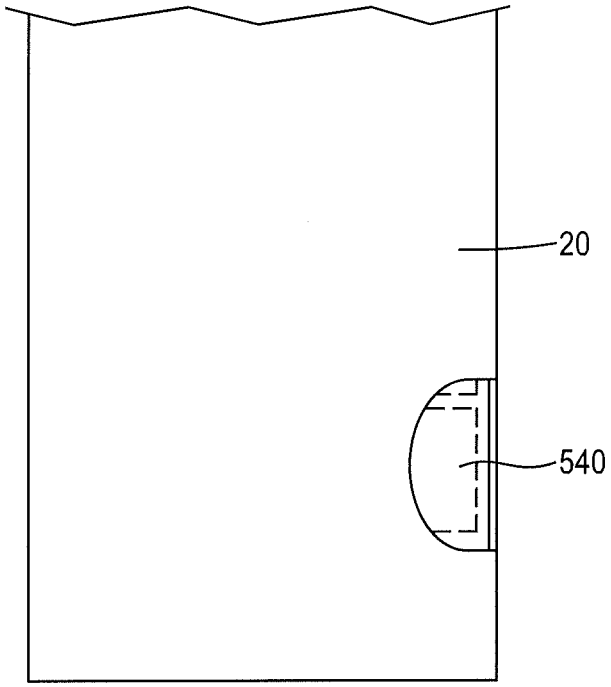
FIG. 8 is a lower front partial view of the dispenser unit of FIG. 1.
Figure 9:
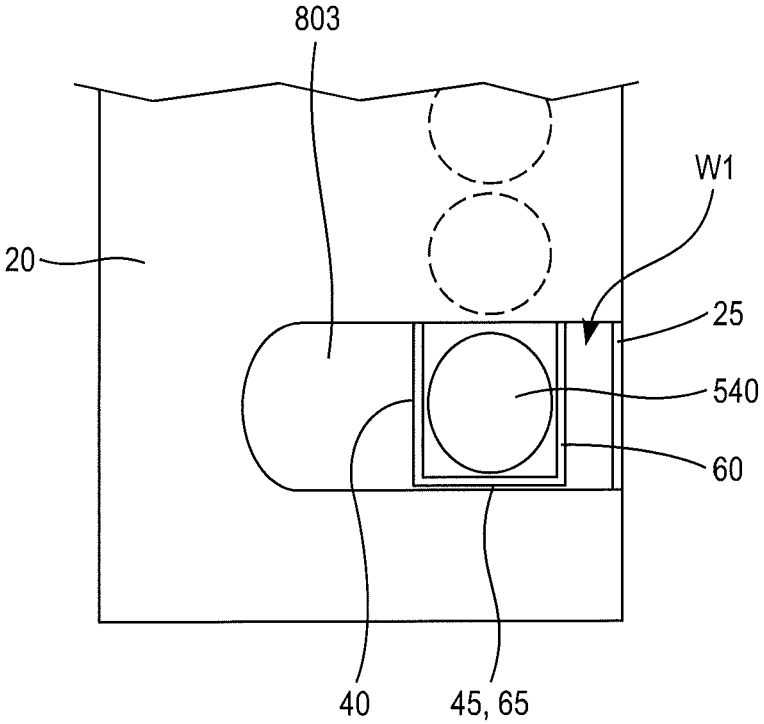
FIG. 9 is a lower side partial view of the dispenser unit of FIG. 1.

Referring to FIGS. 8 and 9, when viewed from the front of the dispensing unit ("display") 500, the opening 15 is sufficiently long so as to provide a consumer a partial view of an end portion of a container 540 that is available for withdrawal from the carton 530 (not shown). At the side of the display, spaces W1 and 803 are provided at opposite sides of a container 540 to provide adequate room and facilitate placement of a thumb and finger on the sides of a presented end portion of the container 540 to enable its withdrawal by the consumer.

The dispenser 510 is erected from blank 100 that is made of paper according to one embodiment. It will be apparent to one skilled in the art that dispenser 510 could also be formed as an integral plastic product While the above dispensing unit, blanks, and method of forming the same have been described in detail with reference to specific embodiments thereof, it will be apparent to those skilled in the art that various changes and modifications can be made, and equivalents employed, without departing from the scope of the appended claims.

What is claimed is:

1. A dispensing unit comprising:

a dispenser having interior walls defining an interior receiving slot therebetween and an interior bottom wall defining a bottom surface of said receiving slot; and a carton configured to contain a plurality of tubular containers, the carton being removably disposed within the interior receiving slot of the dispenser such that said carton engages the bottom surface of the receiving slot;

wherein said dispenser includes an outer wall defining a dispensing opening aligned with a removal opening in said carton, the opening in the carton being adapted for removal of one of said plurality of tubular containers therethrough; and wherein said dispenser includes a planar rear wall and a semi-elliptical shaped front wall extending therefrom, said dispensing opening being disposed in the semi-elliptical front wall so as to adjoin said rear wall.

2. The dispensing unit according to claim 1, further comprising a sleeve disposed around an exterior of the dispenser.

3. The dispensing unit according to claim 2, wherein said sleeve comprises a transparent material.

4. The dispensing unit according to claim 1, wherein said interior receiving slot is substantially parallel to said rear wall.

5. The dispensing unit according to claim 1, wherein said dispenser includes a top portion and a bottom portion such that, when in use, said dispensing opening is positioned in the bottom portion of said dispenser.

6. The dispensing unit according to claim 5, wherein said carton includes opposing front and rear walls and opposing side walls, the removal opening in the carton being disposed in a bottom portion of one of said side walls such that, when in use, said carton is disposed within the interior receiving slot of said dispenser and the removal opening of said carton is aligned with said dispensing opening of said dispenser.

7. A blank for a dispenser comprising:

a first panel having at least one tab and defining a dispensing opening;

a second panel hingedly connected to said first panel;

a third panel hingedly connected to said second panel along a fold line, said fold line including at least one slit;

a fourth panel hingedly connected to said third panel and having a first tuck flap;

a fifth panel hingedly connected to said fourth panel;

a sixth panel hingedly connected to said fifth panel and having a second tuck flap; and a glue flap;

wherein said third panel includes an adhesive strip for adhering the first panel thereto when the dispenser is erected.

8. The blank according to claim 7, wherein the first tuck flap includes a further adhesive strip for adhering the second tuck flap thereto when the dispenser is erected.

9. An erectable display comprising;

first and second collapsible structures, said first structure defining a carton receiving slot upon erection of the display, said second structure including a back panel;

a front panel foldable along a first edge portion of said back panel and connectable along an opposite edge portion of said back panel;

arrangement of securing connection of said front panel along said opposite edge portion of back panel;

said first structure including end flaps and arrangement to mutually secure said end flaps;

whereby said mutually secured end flaps provide a stop at an end portion of said carton receiving slot and reinforcement of at least one of said structures; and wherein said securing arrangement of said front panel along said opposite edge portion of back panel comprises tabs at spaced locations along an edge of said front panel and corresponding slots at spaced locations along said opposite edge portion of said back panel and an adhesive disposed along a side panel adjacent said back panel, a portion of said front panel coming into a desired alignment and upon full insertion of said tabs into said slots, whereby said front panel is secured into position with said adhesive.

10. The erectable display as claimed in claim 9, wherein said carton receiving slot cooperates with a carton, said carton holding a plurality of containers, said display and carton mutually arranged to provide presentation and removal of containers from said carton at a lower side portion of said display.

11. The erectable display as claimed in claim 10 further comprising guide panels at an opposite end portion of said carton receiving slot, whereby insertion of a carton into said carton-sleeve is facilitated.

* * * * *